United States Patent [19]

Bodine

[11] 4,073,353

[45] Feb. 14, 1978

[54] SONIC LARGE BORE EARTH AUGER

[76] Inventor: Albert G. Bodine, 7877 Woodley Ave., Van Nuys, Calif. 91406

[21] Appl. No.: 669,385

[22] Filed: Mar. 22, 1976

[51] Int. Cl.[2] ..... E21B 7/04

[52] U.S. Cl. ..... 175/56; 299/15; 175/394

[58] Field of Search ..... 175/56, 55, 57, 62, 175/96, 92, 95, 106, 394; 299/14; 37/DIG. 18

[56] References Cited

U.S. PATENT DOCUMENTS

| | | | |
|---|---|---|---|
| 3,235,311 | 2/1966 | Hagenbook | 175/96 X |
| 3,291,228 | 12/1966 | Bodine, Jr. | 175/106 X |
| 3,367,716 | 2/1968 | Bodine | 175/56 X |
| 3,406,768 | 10/1968 | Miller | 175/56 X |
| 3,550,698 | 12/1970 | Pauley | 175/62 X |
| 3,633,683 | 1/1972 | Shatto, Jr. | 299/14 X |
| 3,633,688 | 1/1972 | Bodine | 175/56 X |

*Primary Examiner*—Ernest R. Purser

*Assistant Examiner*—Richard E. Favreau

*Attorney, Agent, or Firm*—Edward A. Sokolski

[57] ABSTRACT

Means are provided to rotatably drive a cutter blade device about a central point so as to bore a circular hole in the ground. Elastic bar means is vibrationally excited at a sonic frequency by means of an orbital mechanical oscillator, the frequency of the oscillator being adjusted to provide resonant standing wave vibration of the bar means. Vibrational energy is transferred from the bar means to the cutter device in unidirectional (rectified) pulses, the vibrational energy aiding the rotary torque action of the cutter device and causing the earthen material to be broken into small size cuttings. The vibrational energy is applied to the cutter device at a location thereon away from the rotational axis of the cutter device, therefore maximizing the availability of the sonic energy in the cutting action and providing a substantial lever arm at the central portions of the device.

5 Claims, 5 Drawing Figures

SONIC LARGE BORE EARTH AUGER

This invention relates to large bore earth augers such as for use in installing pilings and the like, and more particularly to such a device utilizing resonant sonic energy in its implementation.

With large bore earth augers of the prior art (e.g., for boring holes of the order of 6–8 feet in diameter), very high torques are required in view of the long cutter arm involved in propelling the blade around its circular cutting path. Thus, in such devices of the prior art, rather large reducing gear trains are needed to convert the relatively high speed output of the driver motor or engine to a high torque drive for the auger blades. This involves rather large diameter heavy machinery which is expensive in its construction and cumbersome to handle and transport to and from on-site locations.

The present invention obviates the aforementioned short-comings of the prior art by utilizing sonic energy to aid the driving of the auger blades such that heavy duty gearing is not needed to obtain the high torque for driving such blades. Further, the sonic energy breaks the earthen material into small sized cuttings which are more easily removed from the hole.

It is therefore an object of this invention to obviate the need for heavy duty speed reducing gearing in large bore earth augers.

It is a further object of this invention to increase the cutting speed and efficiency of operation of large bore earth augers by utilizing sonic energy in driving the auger bit device.

It is still another object of this invention to provide a large bore earth auger which breaks the earthen material into small cuttings which can be readily removed.

Other objects of this invention will become apparent as the description proceeds in connection with the accompanying drawings, of which:

Figure 1:
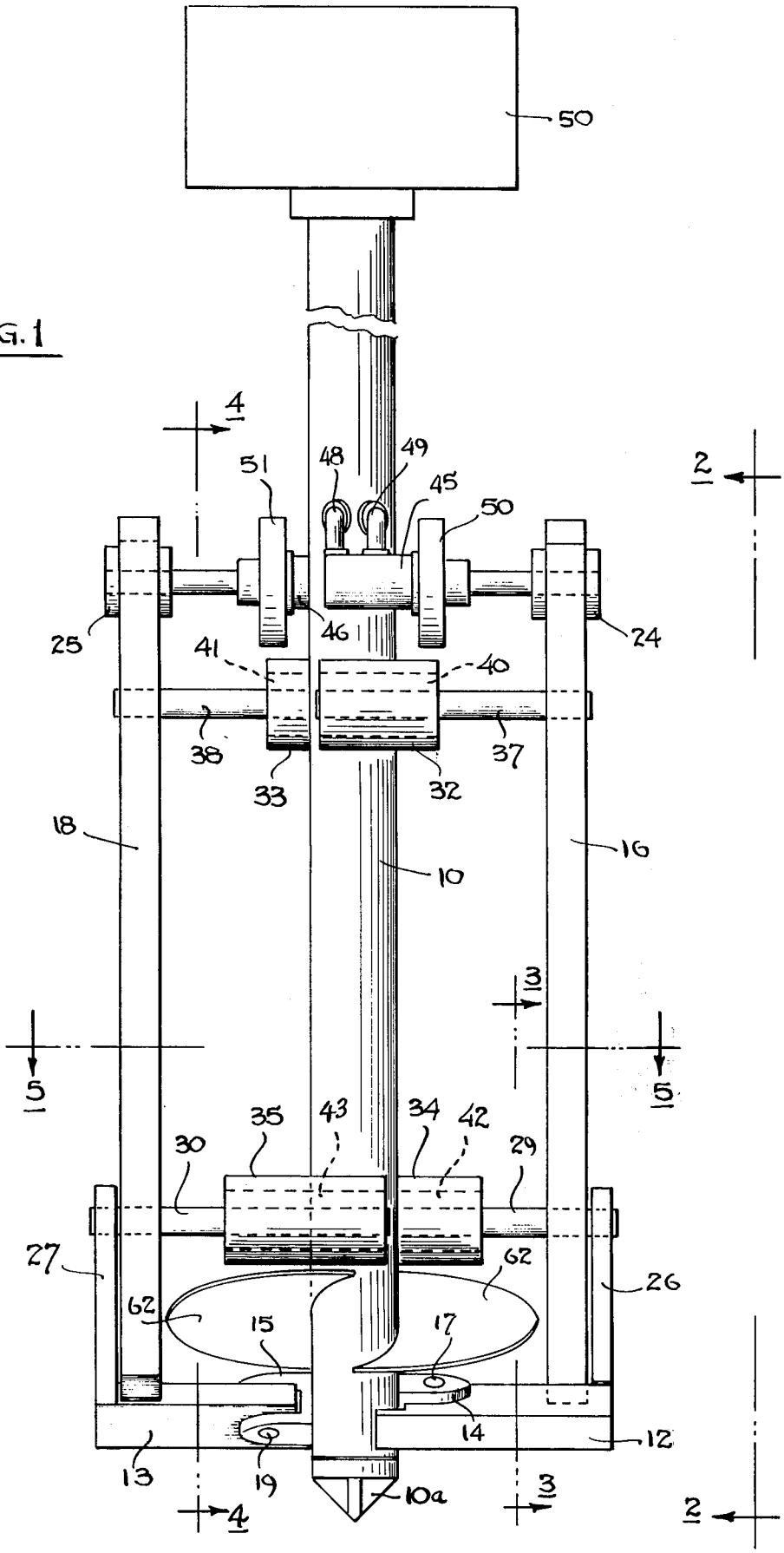
FIG. 1 is a side elevational view of one embodiment of the invention.

Briefly described, the device of the invention is as follows: Blades for boring a hole in earthen material are attached laterally to the end of a drive stem which is rotatably driven so as to bore a hole having a radius corresponding to the distance that the blade or blades extend laterally from the rotational axis of the stem. Elastic bar means is supported, sometimes generally longitudinally of the stem axis, with a portion of said bar means in proximity to the back surface of the blade device, i.e., the surface opposite the cutting edge thereof and at a location along this surface removed some distance out along the radius from the drive stem. A mechanical oscillator is rotatably driven in orbital fashion so as to generate vibrational energy at a sonic frequency. The vibrational output of the oscillator is coupled to the elastic bar means and the speed of rotation of the oscillator adjusted so as to cause resonant elastic vibration of the bar. Vibrational energy is transferred from the bar to said back of the blade in unidirectional pulses, thereby driving the forward cutting edge of the blade in a single direction in pulsating fashion at the sonic frequency of vibration. The vibrational energy aids the torsional cutting action of the blades and further results in vibrational pulverization of the earthen material to reduce it to relatively small particles which can be more easily removed. A shearing type of action comes about from the turning motion of the blade.

It has been found most helpful in analyzing the operation of this invention to analogize the acoustically vibrating circuit utilized to an equivalent electrical circuit. This sort of approach to analysis is well known to those skilled in the art and is described, for example, in Chapter 2 of "Sonics" by Heuter and Bolt, published in 1955 by John Wiley and Sons. In making such an analogy, force F is equated with electrical voltage E, velocity of vibration $u$ is equated with electrical current $i$, mechanical compliance $C_m$ is equated with electrical capacitance $C_e$, mass M is equated with electrical inductance L, mechanical resistance (friction) $R_m$ is equated with electrical resistance R and mechanical impedance $Z_m$ is equated with electrical impedance $Z_e$.

Thus it can be shown that if a system is vibrated by means of an acoustical sinusoidal force $F_o \sin\omega t$ ($\omega$ being equal to $2\pi$ times the frequency of vibration), that $$Z_m = R_m + j(\omega M - \frac{1}{\omega C_m}) = \frac{F_o \sin\omega t}{u} \quad (1)$$

Where $\omega M$ is equal to $$\frac{1}{\omega C_m},$$

a resonant condition exists, and the effective mechanical impedance $Z_m$ is equal to the mechanical resistance $R_m$, the reactive impedance components $\omega M$ and $$\frac{1}{\omega C_m}$$

cancelling each other out. Under such a resonant condition, velocity of vibration $u$ is at a maximum, power factor is unity, and energy is more efficiently delivered to a load to which the resonant system may be coupled. It can also be shown that the resonant vibration frequency, "$f$" of the system, ($\omega$ being equal to $2\pi f$)is as follows:

$$F = \frac{1}{2\pi\sqrt{MC_m}} \quad (2)$$

It is important to note the significance of the attainment of high acoustical "Q" in the resonant system being driven, to increase the efficiency of the vibration thereof and to provide a maximum amount of power. As for an equivalent electrical circuit, the "Q" of an acoustically vibrating circuit is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating circuit can be maximized to make for highly efficient high-amplitude vibration by minimizing the effect of friction in the circuit and/or maximizing the effect of mass in such circuit.

It is also to be noted that orbiting mass oscillators are utilized in the implemenatation of the invention that automatically adjust their output frequency and phase to maintain resonance with changes in the characteristics of the load. Thus, in the face of changes in the effective mass and compliance presented by the load with changes in the conditions of the work material as it is sonically excited, the systems automatically is maintained in optimum resonant operation by virtue of the "lock-in" characteristic of Applicant's unique orbiting mass oscillators. Furthermore in this connection the orbiting mass oscillator automatically changes not only its frequency but its phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

Referring now to the Figures, cutter blades 12 and 13 are supported on central stem 10 for limited angular movement substantially transverse to the longitudinal axis of the stem by means of pins 17 and 19 through brackets 14 and 15 which brackets are fixedly attached to the stem, and support posts 26 and 27 which are fixedly joined to blades 12 and 13 respectively at one of the ends thereof, and pivotally supported on support bars 29 and 30 at the other of the ends thereof. Blades 12 and 13 are supported on brackets 14 and 15 by means of pins 17 and 19 respectively which are fixedly attached to the brackets and on which the blades are pivotally supported. Central stem 10 has a pointed pilot 10*a* to center the stem in the ground during the boring operation. Resonator bars 16 and 18, which are fabricated of an elastic material such as steel, are supported on central stem 10 by means of upper trunnions 32 and 33 and lower trunnions 34 and 35. Resonant bars 16 and 18 are pivotally supported on upper support bars 37 and 38 and lower support bars 29 and 30 respectively. Support bars 37, 38, 29 and 30 are respectively supported in association trunnions 32–35 respectively on associated rubber bushings 40–43, the bushings providing vibrational isolation of the bars from the trunnions and stem 10 to which the trunnions are fixedly attached, as for example by welding.

Fixedly supported in each of resonant bars 16 and 18 is an orbiting mass oscillator 24 and 25 respectively. The orbiting mass oscillators may be of the type described in my U.S. Pat. Nos. 2,960,314, 3,417,966 or No. 3,581,969. This type of oscillator has an eccentric rotor which is rotatably driven so as to generate vibratory energy at a sonic frequency, in this instance the vibrations desired being transverse to the longitudinal dimensions of the resonant bars. The rotors of oscillators 24 and 25 are rotatably driven by means of hydraulic motors 45 and 46 respectively, which have associated flywheels 50 and 51. Drive fluid is provided to motor 45 through inlet and oulet conduits 48 and 49, while motor 46 receives its drive through similar conduits (not shown).

Rotary screw flight 62 is welded to center stem 10 to trap the cuttings.

Figure 2:
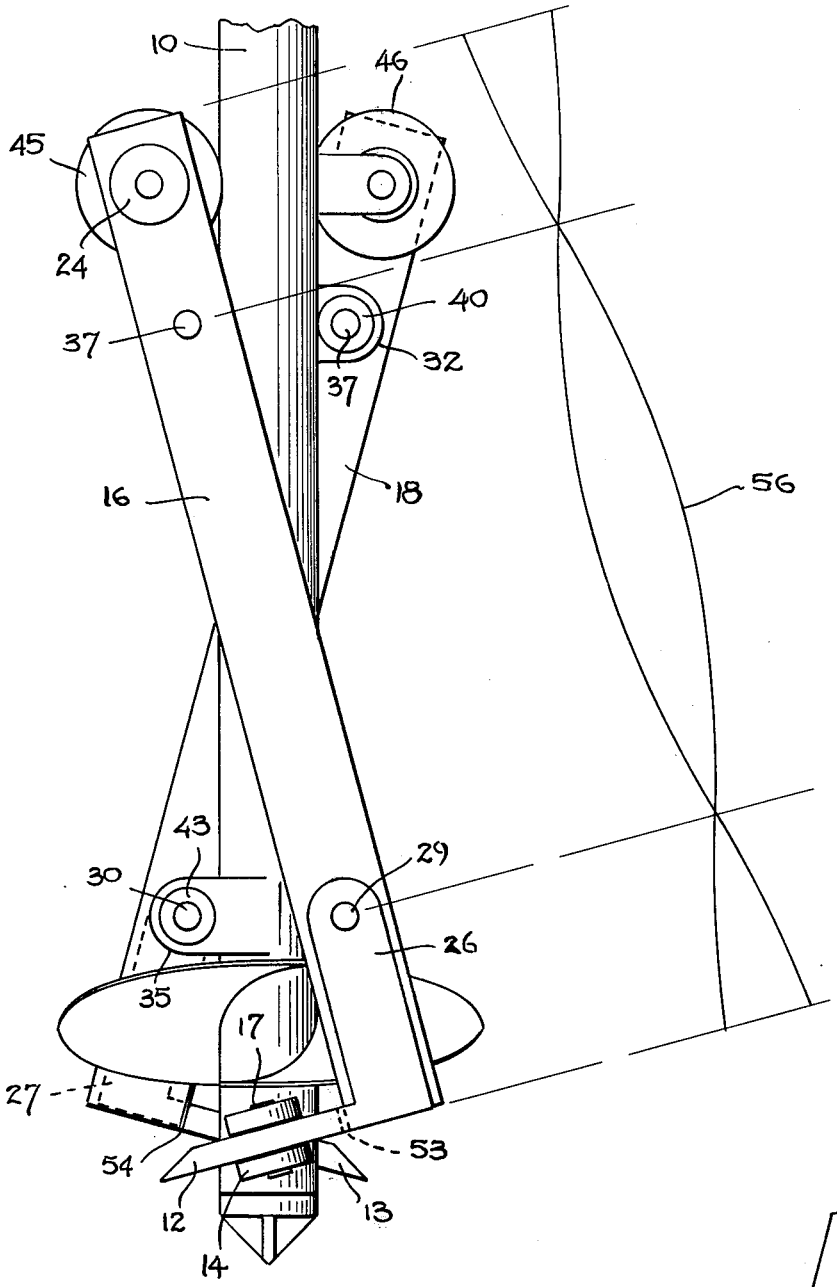
FIG. 2 is an end elevational view of the embodiment of FIG. 1 as indicated by 2—2 in FIG. 1.
Figure 3:
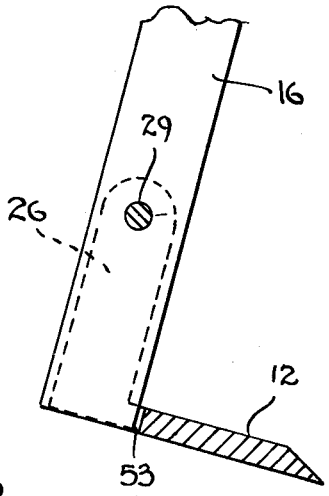
FIG. 3 is a cross-sectional view taken along the plane indicated by 3—3 in FIG. 1.
Figure 4:
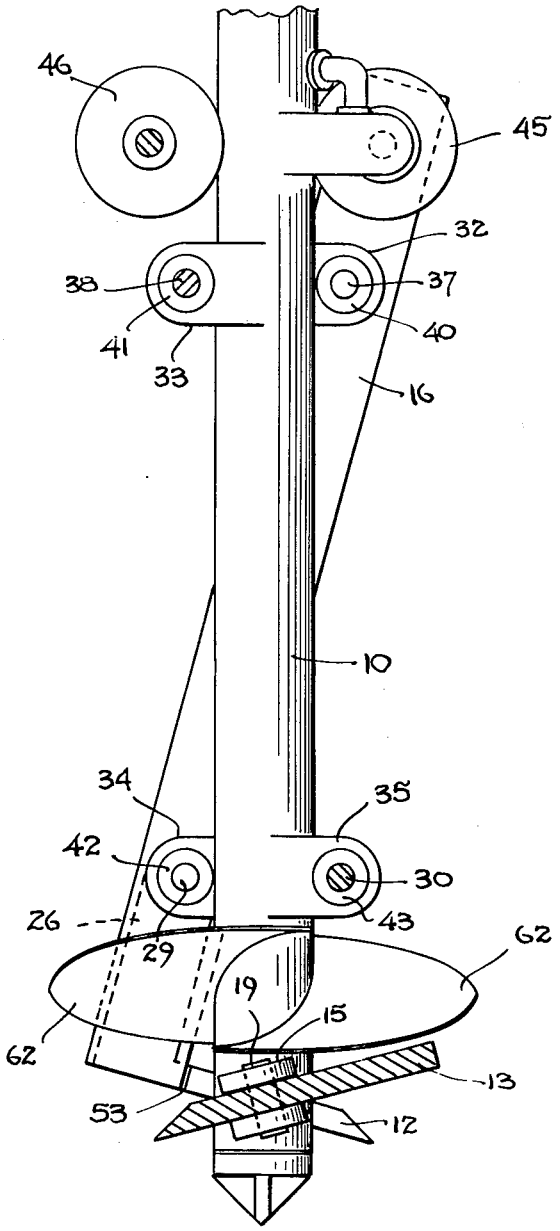
FIG. 4 is a cross-sectional view taken along the plane indicated by 4—4 in FIG. 1.
Figure 5:
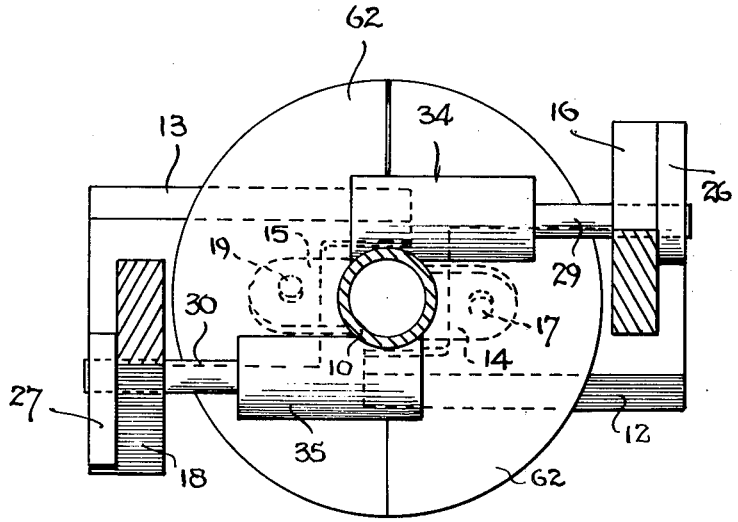
FIG. 5 is a cross-sectional view taken along the plane indicated by 5—5 in FIG. 1.

In operation, central stem 10 is rotatably driven at a relatively slow speed by means of rotatable drive means 50 which may comprise a motor or engine drive. Rotating along with stem 10 are resonant bars 16 and 18 and cutter bars 12 and 13, which are connected to the stem. At the same time as the stem is being rotated, motors 45 and 46 are energized to rotatably drive oscillators 24 and 25 respectively at a frequency such as to set up resonant elastic vibration in a lateral vibration mode in bars 16 and 18, as indicated by graph lines 56 in FIG. 2.

It is to be noted that the resonant bars 16 and 18 are attached to the upper and lower support bars at nodal points in the standing wave vibration pattern so as to minimize energy dissipation in the stem. The lateral vibrational energy developed in resonant bars 16 and 18 is transferred to the back surfaces of blades 12 and 13 in unidirectional pulses in view of the rectifier gaps 53 and 54 formed between the bar members and the cutter blades. As the cutter blades are rotated by central stem 10, the vibrational energy imparted thereto from resonant bars 16 and 18 not only aids their torsional driving but also operates to pulverize the earthen material, reducing it to relatively small particles which can be readily caught by screw flight 62 to spin off at ground level in normal manner, or removed by means of a conventional conveyor belt or by mixing the particles with water to form a slurry which can be pumped out conventionally.

It is to be noted that in view of the fact that the blades are vibrationally driven by the resonant bars in opposition, that the vibrational energy is effectively balanced at the centrally located stem to effect substantially zero net reaction on the stem. Thus, maximum energy is delivered to the outer portions of the blade where maximum force is needed, while the dissipation of the energy in the stem is avoided. Moreover, there is a large leverage torque applied to the central region, along with a shearing action since each blade vibrates with an arcuate motion.

The device of the present invention thus provides means for greatly increasing the efficiency of operation and simplifying the drive mechanism of a large bore earth auger.

While the invention has been described and illustrated in detail, it is to be clearly understood that this is intended by way of illustration and example only and is not to be taken by way of limitation, the spirit and scope of the invention being limited only by the terms of the following claims.

I claim:

1. In an earth hole boring auger having cutter blade means and drive means for driving said cutter blade means rotatably around a centrally positioned axis, the improvement wherein means are provided to sonically drive said blade means unidirectionally with arcuate motion along the extended cutting edge of said blade means comprising:

resonant bar means, means for supporting the resonant bar means on said drive means for rotation therewith, said resonant bar means being supported with a vibratory energy delivering portion thereof in proximity to a face portion of said cutter blade means located radially out from said centrally positioned axis and opposite to the cutting edge thereof, a mechanical oscillator having an orbiting rotor connected to said resonant bar means, and drive means for rotatably driving the rotor of said oscillator means so as to set up resonant standing wave vibrations of the resonant bar means, whereby resonant energy is transferred from said bar means to said cutter blade means in unidirectional torque pulses increasing in vibrational amplitude radially from said axis so as to vibrationally drive the cutting edge of said cutter means against the earthen material with arcuate vibration which provides a shearing type of vibratory turning action with resonant pulverizing force as the cutter blade drive means simultaneously drives the cutter blade means rotatably.

2. The device of claim 1 wherein said resonant bar means comprises a distributed longitudnal bar structure positioned around said axis, said cutter blade means comprising cutter blades also distributed around said axis.

3. An earth augering machine comprising:

a central drive stem, a pair of cutter blades attached to said drive stem near one end thereof, said cutter blades extending laterally out from said drive stem in directions substantially normal to the longitudinal axis of said drive stem, a pair of resonant bar members, means for supporting said resonant bar members with their longitudinal axes substantially parallel to the longitudinal axis of said drive stem and with one end thereof proximate to the face of an associated one of said cutter blades opposite to the face of the cutting edge thereof, a mechanical oscillator having an orbiting rotor mounted on each of said resonant bars, drive means for rotatably driving the rotors of said oscillators at a speed such as to set up resonant elastic lateral mode vibration in each of said bars whereby said bars transfer unidirectional pulses of vibrational energy to the blades, and means for rotatably driving said stem and along with it the blades and resonant bars while the blades are being vibrationally driven by the bars.

4. The device of claim 3 wherein said means for supporting the bars and cutter blades on said central stem comprises a first and second set of trunnions separated from each other longitudinally and fixedly attached to said stem, bar means pivotally connected to said resonant bars and said cutter blades and means for attaching each of said bar means to its associated trunnion, said last mentioned attachment means comprising means for vibrationally isolating the bar means from the trunnions.

5. In an earth auger having cutter blade means and drive means for driving said cutter blade means around a centrally positioned axis, the improvement wherein means are provided to sonically drive said blade means unidirectionally with arcuate motion along the extended cutting edge of said blade means comprising:

resonant bar means comprising at least a pair of longitudinal bars positioned opposite each other, means for supporting the longitudinal bars on said drive means for rotation therewith, said resonant bar means being supported with a vibratory energy delivering portion thereof in proximity to a face of said cutter blade means opposite to the cutting edge thereof, said cutter blade drive means comprising a central stem, said cutter blade means comprising a cutter blade associated with each of said bars, said cutter blades being attached at one end thereof to said stem and extending laterally away from said stem, said bars being positioned near the ends of the cutter blades opposite said one ends thereof, a mechanical oscillator having an orbiting rotor connected to said resonant bar means, and drive means for rotatably driving the rotor of said oscillator means so as to set up lateral resonant standing wave vibrations of the resonant bar means, whereby resonant energy is transferred from said bar means to said cutter blade means in unidirectional pulses so as to vibrationally drive the cutting edge of said cutter means against the earthen material with arcuate vibration as the cutter blade drive means simultaneously drives the cutter blade means rotatably.

* * * * *